US008991470B1

(12) United States Patent
Pacheco

(10) Patent No.: US 8,991,470 B1
(45) Date of Patent: Mar. 31, 2015

(54) PORTABLE GATE ASSEMBLY

(71) Applicant: Steven A. Pacheco, Lakewood, CO (US)

(72) Inventor: Steven A. Pacheco, Lakewood, CO (US)

( * ) Notice: Subject to any disclaimer, the term of this patent is extended or adjusted under 35 U.S.C. 154(b) by 0 days.

(21) Appl. No.: 13/936,027

(22) Filed: Jul. 5, 2013

(51) Int. Cl.

| | |
|---|---|
| ***A47H 1/00*** | (2006.01) |
| ***A47D 13/06*** | (2006.01) |
| ***B65D 33/06*** | (2006.01) |
| ***B65D 33/14*** | (2006.01) |
| ***E06B 11/02*** | (2006.01) |
| ***G08B 3/00*** | (2006.01) |

(52) U.S. Cl.
CPC ..... *A47D 13/06* (2013.01); *B65D 33/06* (2013.01); *B65D 33/14* (2013.01); *E06B 11/02* (2013.01); *G08B 3/00* (2013.01)
USPC ..... 160/240; 160/350

(58) Field of Classification Search
CPC ... E04B 2/7433; E04B 2/7407; E04B 2/7416; E04G 21/24; E01F 13/028; G08B 13/1436
USPC ..... 160/368.1, 24, 264, 351, 238, 384, 10
See application file for complete search history.

(56) References Cited

U.S. PATENT DOCUMENTS

| | | | | |
|---|---|---|---|---|
| 2,855,037 | A * | 10/1958 | Stiffel | 160/135 |
| 3,308,875 | A * | 3/1967 | Abrams | 160/369 |
| 4,685,484 | A * | 8/1987 | Moneta | 135/87 |
| 5,402,988 | A * | 4/1995 | Eisele | 256/24 |
| 5,402,999 | A * | 4/1995 | Keehn, Sr. | 473/472 |
| 5,636,679 | A * | 6/1997 | Miller et al. | 160/317 |
| 5,660,144 | A * | 8/1997 | Venti | 119/416 |
| D410,289 | S | 5/1999 | Howard et al. | |
| 6,089,302 | A | 7/2000 | Britt | |
| 6,092,580 | A * | 7/2000 | Lucas | 160/113 |
| 6,114,963 | A * | 9/2000 | Blake et al. | 340/573.4 |
| 6,142,701 | A * | 11/2000 | Falcon | 404/6 |
| D440,411 | S | 4/2001 | Gomes, Jr. | |
| 6,395,369 | B1 * | 5/2002 | Randone | 428/99 |
| 6,575,435 | B1 * | 6/2003 | Kotzen | 256/24 |
| 6,733,204 | B1 * | 5/2004 | Paniccia | 404/6 |
| 6,779,537 | B1 * | 8/2004 | Miller | 135/117 |
| 6,794,011 | B2 * | 9/2004 | Allard | 428/99 |
| 6,807,999 | B1 | 10/2004 | Bowen et al. | |
| 6,998,981 | B1 * | 2/2006 | Montague | 340/540 |
| 7,178,792 | B2 * | 2/2007 | Monahan et al. | 256/73 |
| 7,219,709 | B1 | 5/2007 | Williams | |
| 7,240,637 | B2 * | 7/2007 | Rosen | 119/524 |
| 7,377,490 | B1 * | 5/2008 | Khosravian | 256/24 |
| 7,600,554 | B1 * | 10/2009 | Wright et al. | 160/327 |
| 7,775,251 | B2 * | 8/2010 | Ward | 160/89 |
| 8,191,604 | B2 * | 6/2012 | Wang | 160/296 |
| 8,327,565 | B2 * | 12/2012 | Boltz et al. | 40/603 |
| 2002/0194786 | A1 * | 12/2002 | Hincher, Sr. | 49/463 |
| 2005/0072074 | A1 | 4/2005 | Moore | |
| 2005/0098770 | A1 * | 5/2005 | Schell | 256/25 |
| 2007/0176158 | A1 | 8/2007 | Robinson | |
| 2007/0228349 | A1 * | 10/2007 | Smith | 256/12.5 |

(Continued)

*Primary Examiner* — Katherine Mitchell
*Assistant Examiner* — Johnnie A Shablack

(57) ABSTRACT

A portable gate assembly provides a portable enclosure that can fit any doorway in order to confine kids and pets to a desired area. The assembly includes a pair of spaced posts and a flexible net coupled to and extending between the posts. A sound emitter is coupled to the net. The sound emitter has a sensor positioned therein. The sound emitter is operationally coupled to the sensor wherein the sound emitter emits an audible indicator upon the sensor sending a proximity signal to the sound emitter when an object or a user is within a predetermined distance of the net.

1 Claim, 5 Drawing Sheets

(56) References Cited

U.S. PATENT DOCUMENTS

2007/0235068 A1* 10/2007 Green ..... 135/114
2009/0071611 A1* 3/2009 Osmond ..... 160/130
2011/0284171 A1* 11/2011 Daniele ..... 160/10
2012/0067531 A1* 3/2012 Ehrsam ..... 160/368.1
2012/0241108 A1* 9/2012 Marszalek et al. ..... 160/264
2013/0221301 A1* 8/2013 Cowie et al. ..... 256/24

* cited by examiner

PORTABLE GATE ASSEMBLY

BACKGROUND OF THE DISCLOSURE

Field of the Disclosure

The disclosure relates to gate assemblies and more particularly pertains to a new gate assembly for providing a portable enclosure that can fit any doorway in order to confine kids and pets to a desired area.

SUMMARY OF THE DISCLOSURE

An embodiment of the disclosure meets the needs presented above by generally comprising a pair of spaced posts and a flexible net coupled to and extending between the posts. A sound emitter is coupled to the net. The sound emitter has a sensor positioned therein. The sound emitter is operationally coupled to the sensor wherein the sound emitter emits an audible indicator upon the sensor sending a proximity signal to the sound emitter when an object or a user is within a predetermined distance of the net.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
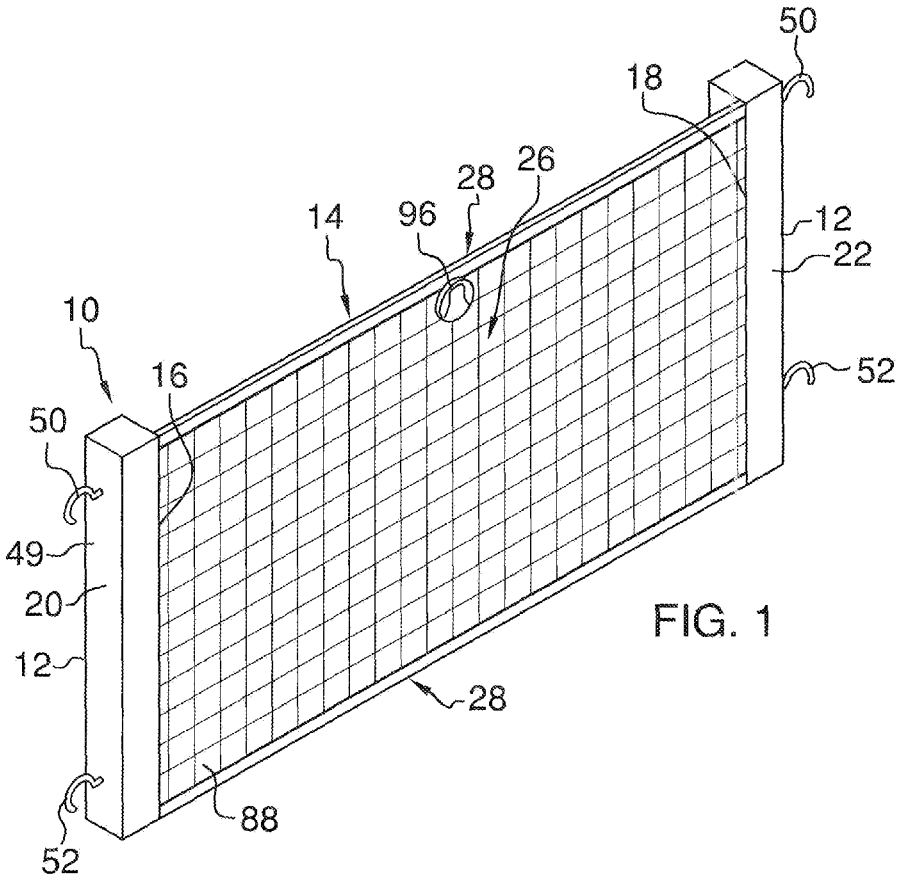
FIG. 1 is a top front side perspective view of a portable gate assembly according to an embodiment of the disclosure.
Figure 2:
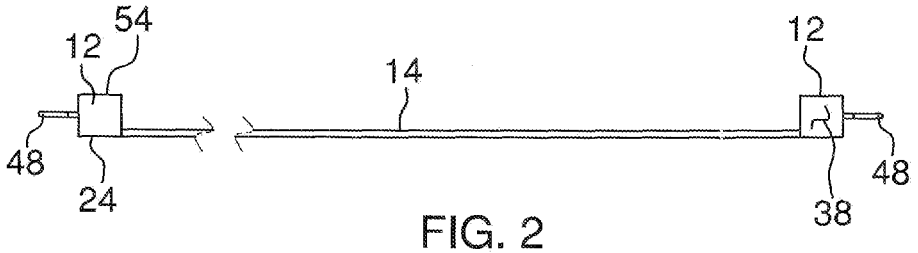
FIG. 2 is a top view of an embodiment of the disclosure.
Figure 3:
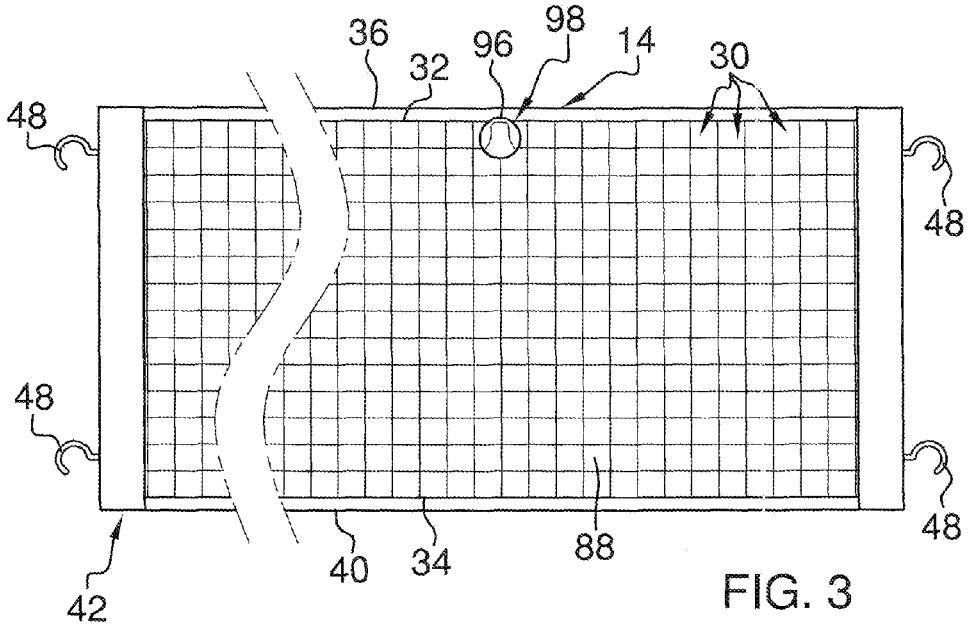
FIG. 3 is a front view of an embodiment of the disclosure.
Figure 4:
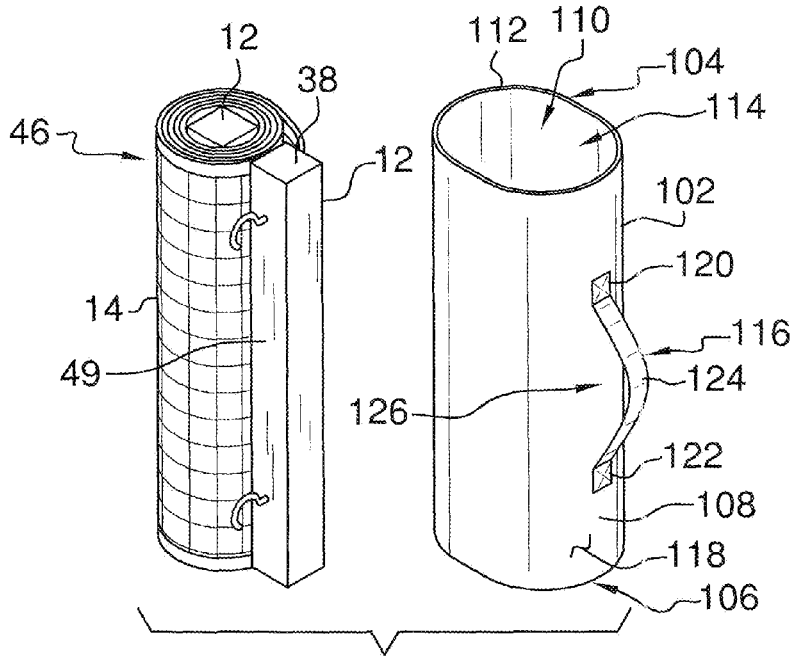
FIG. 4 is a top front side perspective view of an embodiment of the disclosure in the storage position.
Figure 5:
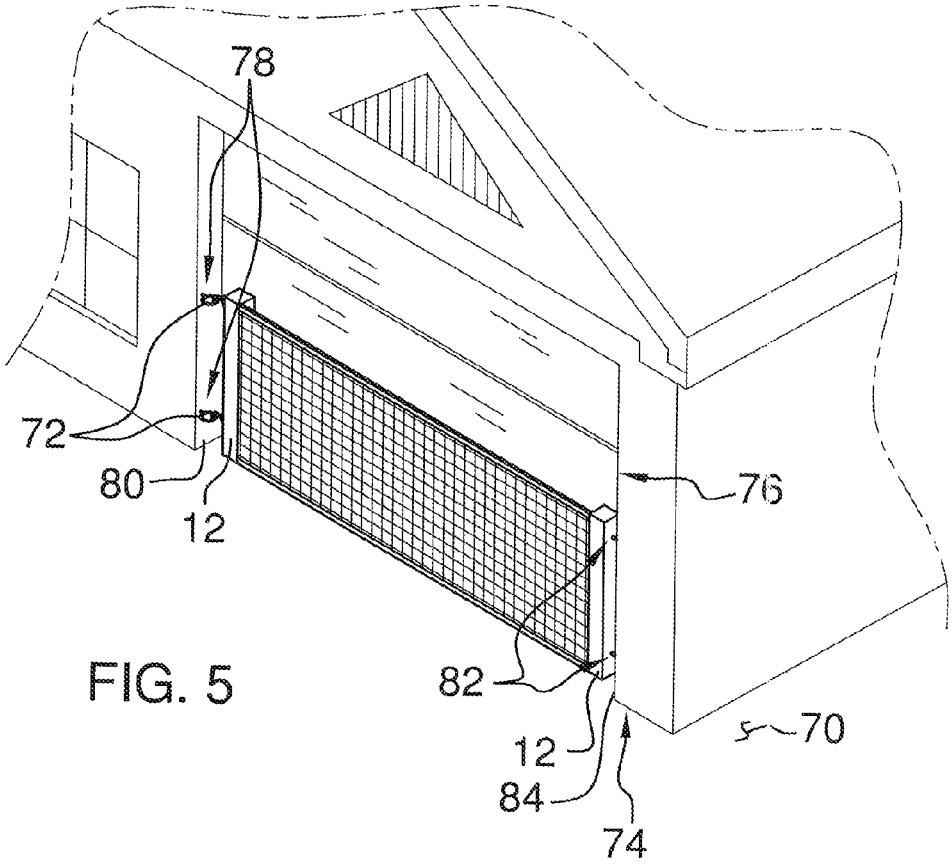
FIG. 5 is a top front side view of an embodiment of the disclosure in use.
Figure 6:
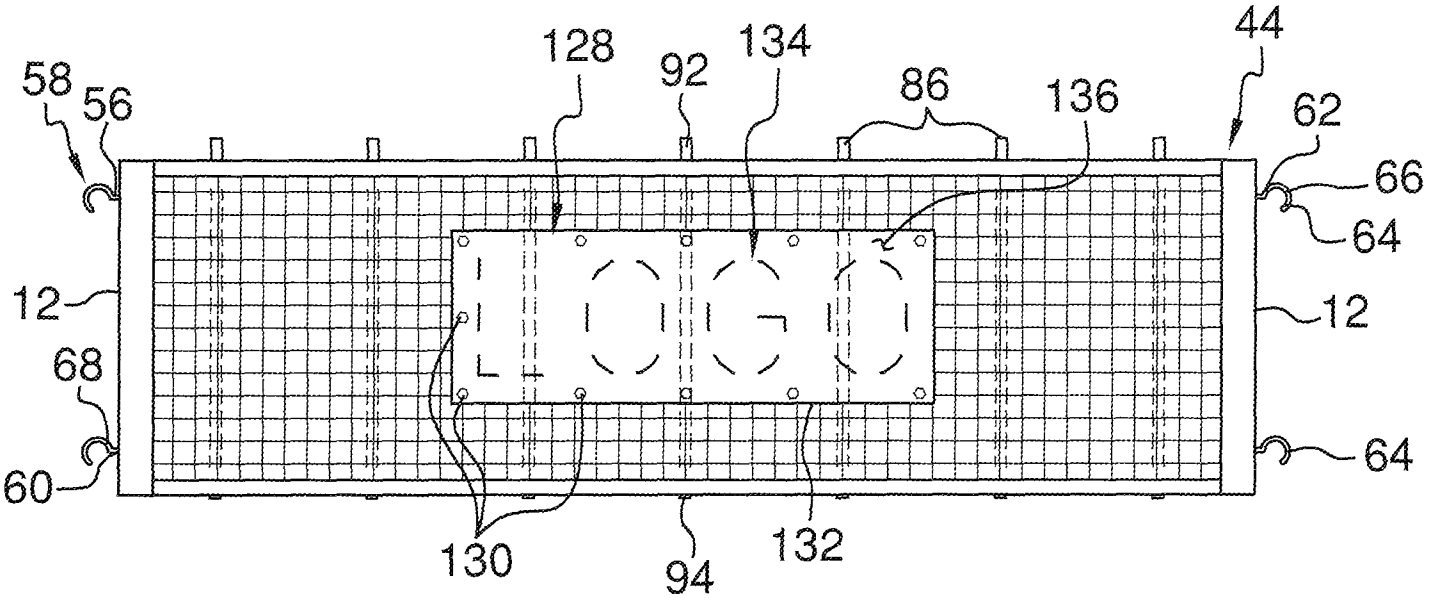
FIG. 6 is a front view of an embodiment of the disclosure.
Figure 7:
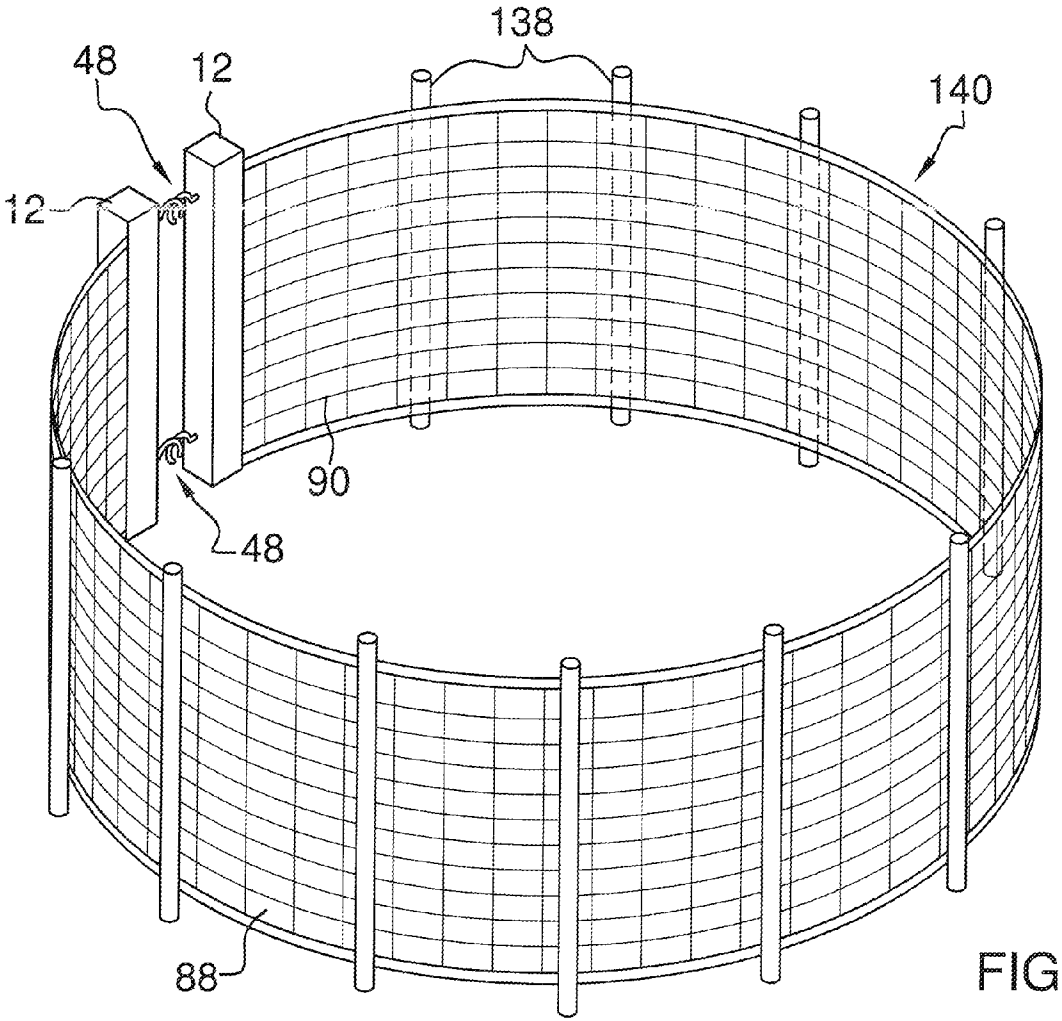
FIG. 7 is a top front side perspective view of an embodiment of the disclosure in a circular configuration.

With reference now to the drawings, and in particular to FIGS. 1 through 7 thereof, a new gate assembly embodying the principles and concepts of an embodiment of the disclosure and generally designated by the reference numeral 10 will be described.

As best illustrated in FIGS. 1 through 7, the portable gate assembly 10 generally comprises a pair of spaced posts 12. A flexible net 14 is coupled to and extends between the posts 12. The net 14 has a first end 16 and a second end 18 wherein a first one 20 of the posts 12 is coupled to the first end 16 and a second one 22 of the posts 12 is coupled to the second end 18.

The net 14 may be aligned with a front edge 24 of each of the posts 12. The net 14 preferably comprises an open-weaved portion 26 and a closed-weaved portion 28 wherein the open-weaved portion 26 has a plurality of gaps 30 positioned therein. The closed-weaved portion 28 is preferably coupled to a top edge 32 and a bottom edge 34 of the open-weaved portion 26. An upper edge 36 of the net 14 may be aligned with a top end 38 of the posts 12. Likewise, a lower edge 40 of the net 14 may aligned with a lower end 42 of the posts 12. The net 14 is selectively positionable between an extended position 44 and a storage position 46 wherein the net 14 is rotatably mounted around a selectable one of the posts 12 when the net 14 is in the storage position 46.

A pair of first hooks 48 is coupled to an outer side 49 of each of the posts 12. Each of the first hooks 48 comprises an upper hook 50 and a lower hook 52. The upper hooks 50 are positioned proximate the top end 38 of the posts 12. The lower hooks 52 are positioned proximate the lower end 42 of the posts 12. The first hooks 48 may be centrally positioned between the front edge 24 and a back edge 54 of each of the posts 12. Each of the first hooks 48 has a straight portion 56 and an arcuate portion 58. A first end 60 of the straight portion 56 is coupled to and extends outwardly from the posts 12. The arcuate portion 58 comprises a first end 62, a second end 64, and a medial portion 66 extending between the first 62 and second 64 ends of the arcuate portion 58. A second end 68 of the straight portion 56 is coupled to the first end 62 of the arcuate portion 58. The second end 64 of the arcuate portion 58 of each of the upper hooks 50 is preferably directed toward an associated one of the lower hooks 52. The second end 64 of the arcuate portion 58 of each of the lower hooks 52 is preferably directed toward a ground surface 70.

A plurality of eye hooks 72 may be coupled to a structure 74 around a structural opening 76. The structure 74 may include a garage, a shed, or the like. The eye hooks 72 comprise a first pair 78 of eye hooks 72 coupled to a first side 80 of the structure 74 and a second pair 82 of eye hooks 72 coupled to a second side 84 of the structure 74. Each of the eye hooks 72 is preferably aligned with an associated one of the first hooks 48. Each of the first hooks 48 is couplable to the associated one of the eye hooks 72 wherein the first hooks 48 and the eye hooks 72 are configured to secure the net 14 in a position covering the structural opening 76. The second end 64 of the arcuate portion 58 of the first hooks 48 is insertable into the associated one of the eye hooks 72. Alternatively, the first hooks 48 of one of the posts 12 may be coupled to the first hooks 48 of an adjacent one of the posts 12. In this manner, the net 14 may be positioned in a circular configuration 140 when a pair of the first hooks 48 is coupled to an adjacent pair of the first hooks 48. The circular configuration 140 requires no eye hooks 72 since a structural opening 76 is not being covered. A plurality of spaced stakes 138 may be coupled to the net 14 wherein the stakes 138 are configured for securing the net 14 above the ground surface 70 when the stakes 138 are driven downwardly into the ground surface 70. Additional eye hooks 72 and first hooks 48 may be used as necessary.

A plurality of support rods 86 is coupled to the net 14. The support rods 86 are coupled to one of a first side 88 and a second side 90 of the net 14. The support rods 86 extend between the top edge 32 and the bottom edge 34 of the open-weaved portion 26. An upper end 92 of the support rods 86 extend upwardly above the upper edge 36 of the net 14 wherein the support rods 86 are configured to attach to and hold open a garage door. In this manner, the garage door can still open and close while the assembly 10 is positioned to cover the structural opening 76. A lower end 94 of the support rods 86 extend downwardly below the lower edge 40 of the net 14. The support rods 86 are spaced and positioned parallel to the posts 12. The support rods 86 are preferably garden sticks commonly used in the gardening industry.

A sound emitter 96 is coupled to the net 14. The sound emitter 96 has a sensor 98 positioned therein. The sound emitter 96 is operationally coupled to the sensor 98 wherein the sound emitter 96 emits an audible indicator upon the sensor 98 sending a proximity signal to the sound emitter 96 when an object or a user is within a predetermined distance 100 of the net 14. The predetermined distance 100 may be between approximately 7.5 centimeters and 50.0 centimeters. Thus, depending on the desired objective, the sensor 98 may have high sensitivity or low sensitivity and send a proximity signal accordingly. The sound emitter 96 is preferably positioned on the first side 88 of the net 14. The sound emitter 96 may extend downwardly from the top edge 32 of the open-weaved portion 26. The sound emitter 86 may be centrally positioned between each of the posts 12.

A storage bag 102 has an open top end 104, a closed bottom end 106, and a perimeter wall 108 extending upwardly from the closed bottom end 106. The closed bottom end 106 and the perimeter wall 108 define an interior space 110 configured for receiving the net 14 when the net 14 is in the storage position 46. A perimeter edge 112 of the open top end 104 defines an opening 114 into the interior space 110. A strap 116 may be coupled to an exterior 118 of the storage bag 102 wherein the strap 116 is configured to facilitate carrying the storage bag 102. A first end 120 and a second end 122 of the strap 116 are coupled to the storage bag 102. The strap 116 has a medial portion 124 extending between the first end 120 and the second end 122 of the strap 116. The medial portion 124 of the strap 116 extends outwardly from the storage bag 102 wherein a space 126 is formed between the medial portion 124 of the strap 116 and the perimeter wall 108 of the storage bag 102. The storage bag 102 is constructed from vinyl, plastic, or the like. The assembly 10 is preferably lightweight so as to facilitate carrying of the assembly 10.

A panel 128 is removably coupled to the net 14. The panel 128 is preferably positioned opposite the support rods 86 on one of the first side 88 and the second side 90 of the net 14. The panel 128 may be centrally positioned between the posts 12 and between the upper 36 and lower 40 edges of the net 14. A plurality of fasteners 130 couples the panel 128 to the net 14. The fasteners 130 are preferably positioned around a perimeter 132 of the panel 128. Indicia 134 may be positioned on the panel 128. The indicia 134 are preferably positioned on an exterior surface 136 of the panel 128 such that the indicia 134 are configured for viewing when a user is positioned to face the exterior surface 136 of the panel 128. The indicia 134 may comprise logos, scenic views, educational indicia, games for children, and the like.

The net 14 may be customized so as to fit any structural opening 76 having a width measuring between approximately 50.0 centimeters and 130.0 centimeters and having a length between 700.0 centimeters and 800.0 centimeters. The stakes 138 measure between approximately 90.0 centimeters and 150.0 centimeters. Each post 12 has a length and a width each between 2.0 centimeters and 8.0 centimeters and a height between 5.0 centimeters and 11.0 centimeters. The circular configuration 140 measures between approximately 50.0 centimeters and 250.0 centimeters.

In use, as stated above and shown in the Figures, a piece of wood is cut in order to achieve posts 12 having the dimensions described above. The net 14 is then cut to fit the structural opening 76. The posts 12 are attached to the net 14 using staples and a staple gun. A pair of the first hooks 48 is screwed into each of the posts 12 between approximately 2.0 centimeters and 8.0 centimeters from each of the top end 38 and the lower end 42 of the posts 12. Thus, one screw is inserted into the top end 38 and one screw is inserted into the lower end 42 such that the first hooks 48 extend outwardly from the outer side 49 of each of the posts 12. Two of the eye hooks 72 are attached to the first side 80 of the structure 74 and two of the eye hooks 72 are attached to the second side 84 of the structure 74. The eye hooks 72 are attached so that the first hooks 48 align with the eye hooks 72. Each of the first hooks 48 is inserted into an associated one of the eye hooks 72 such that the net 14 is positioned to cover the structural opening 76. Alternatively, a circular configuration 140 may be achieved when the first hooks 48 of one of the posts 12 are attached to the first hooks 48 of another one of the posts 12. The stakes 138 are used to secure the net 14 of the circular configuration 140 to the ground surface 70 by weaving the stakes 138 through the open-weaved portion 26 and driving the stakes 138 downwardly into the ground surface 70. The assembly 10 can be used in garages, day cares, and anywhere that pets are cared for in order to confine children or pets to a specific location.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A portable gate assembly comprising:

a pair of spaced posts;

a flexible net coupled to and extending between said posts, said net having a first end and a second end wherein a first one of said posts is coupled to said first end and a second one of said posts is coupled to said second end, said net being aligned with a front edge of each of said posts, said net comprising an open-weaved portion and a closed-weaved portion wherein said open-weaved portion has a plurality of gaps positioned therein, said closed-weaved portion being coupled to a top edge and a bottom edge of said open-weaved portion, an upper edge of said net being aligned with a top end of said posts, a lower edge of said net being aligned with a lower end of said posts, said net being selectively positionable between an extended position and a storage position wherein said net is rotatably mounted around a selectable one of said posts when said net is in the storage position;

a pair of first hooks being coupled to each of said posts, each of said first hooks comprising an upper hook and a lower hook, said upper hooks being positioned proximate said top end of said posts, said lower hooks being positioned proximate said lower end of said posts, said first hooks being centrally positioned between said front edge and a back edge of each of said posts, each of said first hooks having a straight portion and an arcuate portion, a first end of said straight portion being coupled to and extending outwardly from said posts, said arcuate portion comprising a first end, a second end, and a medial portion extending between said first and second ends of said arcuate portion, a second end of said straight portion being coupled to said first end of said arcuate portion, said second end of said arcuate portion of each of said upper hooks being directed toward an associated one of said lower hooks, said second end of said arcuate portion of each of said lower hooks being directed toward a ground surface;

a plurality of eye hooks being coupled to a structure around a structural opening, said eye hooks comprising a first pair of eye hooks coupled to a first side of the structure and a second pair of eye hooks coupled to a second side of the structure, each of said eye hooks being aligned with an associated one of said first hooks, each of said first hooks being couplable to said associated one of said eye hooks wherein said first hooks and said eye hooks are configured to secure said net in a position covering the structural opening, said second end of said arcuate portion of said first hooks being insertable into said associated one of said eye hooks;

a storage bag having an open top end, a closed bottom end, and a perimeter wall extending upwardly from said closed bottom end, said closed bottom end and said perimeter wall defining an interior space configured for receiving said net when said net is in the storage position, a perimeter edge of said open top end defining an opening into said interior space;

a strap coupled to an exterior of said storage bag wherein said strap is configured to facilitate carrying said storage bag, a first end and a second end of said strap being coupled to said storage bag, said strap having a medial portion extending between said first end and said second end of said strap, said medial portion of said strap extending outwardly from said storage bag wherein a space is formed between said medial portion of said strap and said perimeter wall of said storage bag;

a sound emitter coupled to said net, said sound emitter having a sensor positioned therein, said sound emitter being operationally coupled to said sensor wherein said sound emitter emits an audible indicator upon said sensor sending a proximity signal to said sound emitter when an object or a user is within a predetermined distance of said net, said sound emitter being positioned on a first side of said net, said sound emitter extending downwardly from said top edge of said open-weaved portion, said sound emitter being centrally positioned between each of said posts;

a plurality of support rods being coupled to said net, said support rods being coupled to one of said first side and a second side of said net, said support rods extending between said top edge and said bottom edge of said open-weaved portion, an upper end of said support rods extending upwardly above said upper edge of said net wherein said support rods are configured to attach to and hold open a garage door, a lower end of said support rods extending downwardly below said lower edge of said net, said support rods being spaced and positioned parallel to said posts;

a panel removably coupled to said net, said panel being positioned opposite said support rods on one of said first side and said second side of said net, said panel being centrally positioned between said posts and between said upper and lower edges of said net;

a plurality of fasteners coupling said panel to said net, said fasteners being positioned around a perimeter of said panel; and indicia positioned on said panel, said indicia being positioned on an exterior surface of said panel such that said indicia is configured for viewing when a user is positioned to face said exterior surface of said panel.

* * * * *